US008492627B2

(12) United States Patent
DuPra

(10) Patent No.: US 8,492,627 B2
(45) Date of Patent: Jul. 23, 2013

(54) AUTOMATIC STRING MUSICAL INSTRUMENT PICK SYSTEM

(76) Inventor: Andre DuPra, Gates, NY (US)

( * ) Notice: Subject to any disclaimer, the term of this patent is extended or adjusted under 35 U.S.C. 154(b) by 72 days.

(21) Appl. No.: 13/287,175

(22) Filed: Nov. 2, 2011

(65) Prior Publication Data

US 2012/0103163 A1 May 3, 2012

Related U.S. Application Data

(60) Provisional application No. 61/409,203, filed on Nov. 2, 2010.

(51) Int. Cl.
*G10F 1/20* (2006.01)

(52) U.S. Cl.
USPC ..... 84/8; 84/7; 84/9; 84/723; 84/726; 84/731

(58) Field of Classification Search
None
See application file for complete search history.

(56) References Cited

U.S. PATENT DOCUMENTS

| | | | | |
|---|---|---|---|---|
| 5,038,657 | A * | 8/1991 | Busley | 84/455 |
| 5,380,948 | A * | 1/1995 | Freimuth et al. | 84/8 |
| 5,698,808 | A * | 12/1997 | Hamlin | 84/722 |
| 5,986,190 | A * | 11/1999 | Wolff et al. | 84/297 R |
| 6,723,904 | B1 * | 4/2004 | Dolan et al. | 84/267 |
| 6,753,466 | B1 * | 6/2004 | Lee | 84/669 |
| 7,285,716 | B2 * | 10/2007 | Gilmore et al. | 84/739 |
| 7,935,876 | B1 * | 5/2011 | West | 84/304 |
| 2005/0172779 | A1 * | 8/2005 | Gilmore et al. | 84/8 |
| 2008/0196571 | A1 * | 8/2008 | Lyles | 84/299 |
| 2012/0103163 | A1 * | 5/2012 | DuPra | 84/9 |
| 2012/0285312 | A1 * | 11/2012 | Lyles et al. | 84/297 R |

* cited by examiner

*Primary Examiner* — Marlon Fletcher
(74) *Attorney, Agent, or Firm* — Tracy Jong Law FIrm; Tracy P. Jong; Cheng Ning Jong

(57) ABSTRACT

A string musical instrument comprising an instrument body having a fretboard and a plurality of electrically common and electrically conductive frets spaced along the fretboard. One or more electrically isolated and electrically conductive vibratory strings are laterally disposed on the instrument body and held in tension over and in close proximity to the frets and a picking means for each of the strings. The picking means is an actuating assembly with a power supply. The actuating assembly is electrically connected to the one or more electrically isolated and electrically conductive vibratory strings.

9 Claims, 10 Drawing Sheets

AUTOMATIC STRING MUSICAL INSTRUMENT PICK SYSTEM

RELATED APPLICATIONS AND PRIORITY CLAIM

This application claims priority to provisional application U.S. Ser. No. 61/409,203 filed Nov. 2, 2010. Said application is incorporated by reference herein in its entirety.

BACKGROUND OF THE INVENTION

1. The Field of the Invention

The present invention is directed generally to automatic pick systems for string instruments, and more particularly, to an automatic pick system for picking guitar strings based on the depression of each guitar string into contact with a fret of a guitar.

2. Background Art

U.S. Pat. No. 5,380,948 to Freimuth et al. (hereinafter Freimuth) discloses a musical stringed instrument including a control circuit for playing with one hand. One hand operation is accomplished by selectively bringing one or more strings into electrical contact with electrical contacts or frets or by depressing switches corresponding to each string. A striker pad impacts a chosen string, causing it to generate a vibration signal which is in turn identified via an identifying means comprising an electrical circuit that includes a Schmitt trigger, a monostable multivibrator and a solid state relay. Each striker pad does not actually pick or pluck a string (i.e., the act of pulling and releasing a string to provide an impulse that vibrates the string). Each striker pad mounted on a rocker arm is simply impacted against a string upon actuation of a solenoid. A return spring then retracts the striker pad once the power provided to the solenoid has been removed.

The Freimuth design has many known drawbacks and limitations. The impact action differs from conventional strumming of a string, and thus, the sound generated is undesirably different. More specifically, such impacting action is unlike those effected manually where a string is generally pulled at a right angle to the lengthwise direction of the string with a finger or plectrum and then released while the finger or plectrum continues to travel in the direction of the pulling action.

Freimuth also lacks the ability to swiftly return the striker pad to its rest position in order to anticipate a subsequent actuation of the striker pad. Once de-actuated, a spring passively returns the solenoid to its rest position before the next actuation of the striker pad can be effected. This prevents the user from playing notes in quick repetition. Freimuth also requires complex components that are subject to mechanical failure and increased manufacturing costs. Vibration is generated due to an impact of a striker pad versus the pulling and releasing of a string in a manual picking action. According to Freimuth's teaching, the quality of string vibration relies on the duration for which a striker pad comes in contact with a string. Such limitation unnecessarily complicates the control of a device for automatically picking a string and causes the corresponding string instrument to be susceptible to sound quality changes.

In view of the foregoing drawbacks, there exists a need for an automatic pick system which is simple in its construction and responsive to rapid playing of notes.

SUMMARY OF THE INVENTION

In accordance with the present invention, there is provided a string musical instrument comprising an instrument body having a fretboard and a plurality of electrically common and electrically conductive frets spaced along the fretboard. One or more electrically isolated and electrically conductive vibratory strings are disposed on the instrument body in laterally spaced relationship and held in tension over and in close proximity to the plurality of the frets. There is also provided a picking means for each of the strings where each string comprises an actuating assembly and a power supply with a current restricted to a level safe for human contact. The actuating assembly and the power supply are electrically connected to the one or more electrically isolated and electrically conductive vibratory strings.

In one embodiment, the instrument body is a guitar body.

Each actuating assembly comprises a solenoid having a core and a return spring such that when the solenoid is energized, the core is retracted. When the solenoid is de-energized, the return spring returns the core to its extended position. The actuating assembly comprises a plectrum wheel having a plurality of teeth symmetrically and angularly disposed about the periphery of the plectrum wheel. The actuating assembly also comprises a shuttle, a striker having an elongated tip pivotably and springingly connected to the shuttle and a plectrum wheel support that is fixedly disposed with respect to the solenoid. The plectrum wheel is configured to rotate about the plectrum wheel support. The shuttle is fixedly attached to the core such that when the solenoid is energized, the tip of the striker comes in contacting engagement with a tooth of the plectrum wheel, thereby causing the plectrum wheel to rotate by an angle of rotation corresponding to one tooth of the plectrum wheel. When the solenoid is de-energized, the core extends to cause the elongated tip of the striker to contact a tooth such that the striker rotates in a direction away from the plectrum wheel to clear an adjacent tooth. One plectrum wheel tooth contacts, pulls and releases a vibratory string as the plectrum wheel completes an angle of rotation corresponding to one tooth, thereby causing the vibratory string to vibrate.

Each detent assembly comprises an L-shaped spring having a first and second convex surfaces, a proximal end and a distal end. The distal end of the L-shaped spring is fixedly disposed with respect to the plectrum wheel support. At rest, the convex surfaces of the L-shaped spring urge against the convex surface of one plectrum wheel tooth and the tip of an adjacent plectrum wheel tooth. As the plectrum wheel rotates by an angle corresponding to one tooth, the L-shaped spring is bent and a leading tooth urges against the L-shaped spring before the L-shaped spring becomes relieved as the leading tooth clears the L-shaped spring and rests between the leading tooth and an immediately trailing tooth.

Each actuating assembly further comprises at least one switch electrically connected to the actuating assembly that is capable of independent actuation.

The present invention further comprises a bridge having an isolator block that comprises at least two adjacent slots. The bridge also comprises a first fine tuner and a second fine tuner, wherein the first fine tuner is disposed in one of the at least two adjacent slots and the second fine tuner is disposed in the other of the at least two adjacent slots such that the first fine tuner is electrically isolated from the second fine tuner.

It is a primary object of the present invention to provide a string musical instrument automated pick system that mimics manual picking.

It is another object of the present invention to provide an automated pick system that enables a user to play a string musical instrument with only one hand.

It is yet another object of the present invention requires few components in an automated pick system assembly.

It is yet another object of the present invention that is easy to install.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification and claims. Also it is to be understood that the phraseology and terminology employed herein are for the purpose of description and should not be regarded as limiting.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

Figure 1:
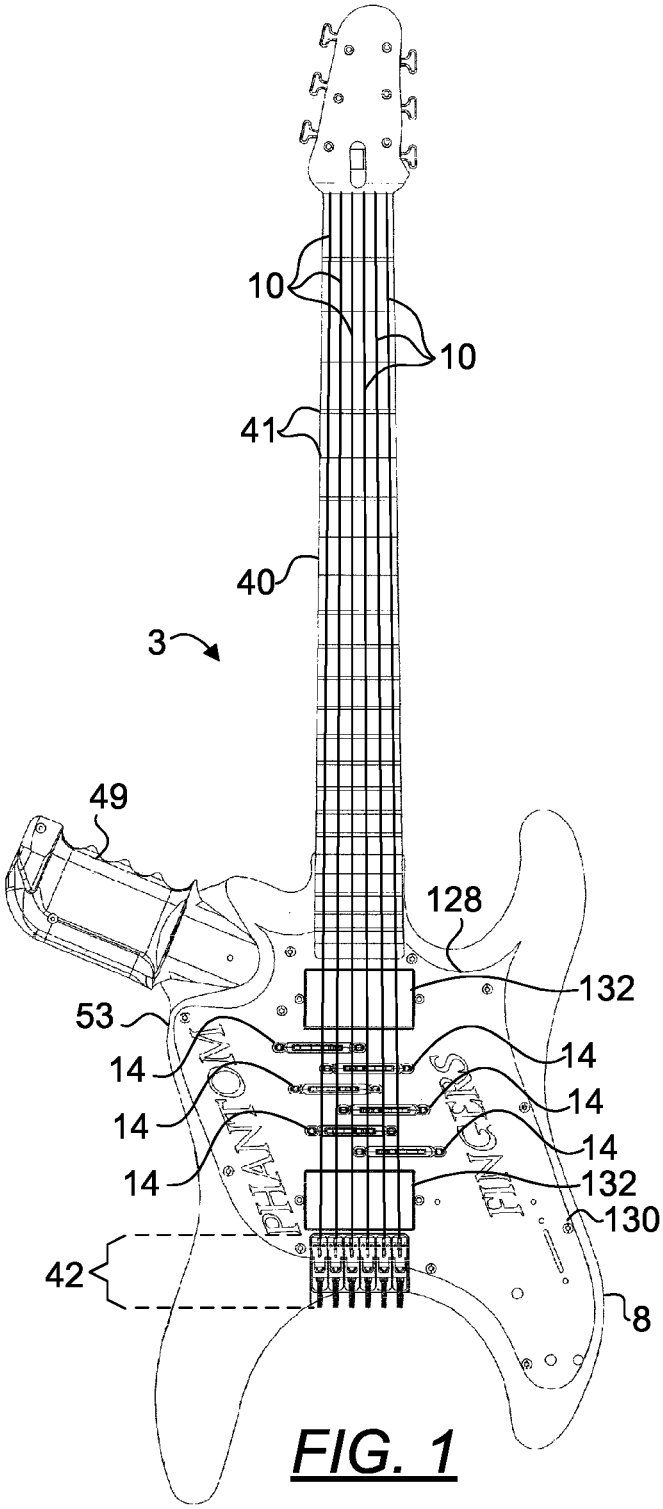
FIG. 1 is a front orthogonal view depicting an actuating assembly, handle for remote picking and a bridge according to the present invention as installed on a guitar body.

The drawings are not to scale, in fact, some aspects have been emphasized for a better illustration and understanding of the written description.

PARTS LIST

2—automated pick
3—guitar
4—position screw
6—threaded aperture
7—through hole in guitar body
8—guitar body
9—adjustment spring
10—string
11—string vibration amplitude
12—plectrum housing
14—plectrum assembly
15—direction of plectrum wheel rotation
16—plectrum wheel
17—plectrum wheel support
18—plectrum wheel tooth
19—tip of plectrum wheel tooth
20—actuating assembly
22—shuttle
23—solenoid core
24—striker
25—tip of striker
26—solenoid
27—striking point where tip of plectrum wheel tooth meets tip of striker
28—spring locator in solenoid core
29—spring adjustor
30—detent assembly
31—outer surface of striker
32—coil housing
34—guide
35—absorber
36—receiver
37—plug
38—spring locator in coil housing
39—return spring
40—fretboard
41—fret
42—bridge
43—power supply
44—headstock
45—machine head
46—button for remotely plucking string with fingers
47—button for remotely plucking string with thumb
48—distance between string and closest plectrum wheel tooth
49—handle on which remote finger and thumb buttons are disposed
50—fine tuner
51—adjustment screw
52—cradle
53—top side of guitar
54—slider block
55—switch
56—swing arm
58—channel
62—swing arm pivot
64—post
66—angle made between slider block and swing arm

68—isolator block
70—slot
72—aperture
74—wall
76—set screw
77—opening
78—plectrum wheel diameter excluding teeth
80—plectrum wheel diameter including teeth
82—height of string when swing arm is retracted
84—height of string when swing arm is erected
86—direction in which string is raised during actuation of solenoid
88—direction in which solenoid retracts
90—L-shaped spring
92—convex surface of plectrum wheel tooth
94—direction in which L-shape spring bends
96—attachment point of L-shaped spring to plectrum housing
98—first convex surface of L-shaped spring
100—second convex surface of L-shaped spring
102—striker spring
104—spring locator in shuttle
106—striker limiter
108—striker horn
110—shuttle impact absorber
112—hinge
114—E chord button
116—A chord button
118—D chord button
120—B chord button
122—G chord button
124—e chord button
126—rear surface of fretboard
128—plate for holding equipment including automatic pick and guitar pickups
130—fastener for securing plate to guitar body
132—guitar pickups

PARTICULAR ADVANTAGES OF THE INVENTION

The present invention provides an automatic string musical instrument pick system that closely mimics manual or natural string picking action, requires few components and is easy to install. The present invention provides a string musical instrument capable of being played with only one hand. By automating the picking action, the picking hand of a user is free to attend to other chores associated with music playing. In contrast to the prior art, the picking action of the present invention causes a string to be contacted, pulled and released, thereby causing an amplitude of vibration that is larger than that produced by a striker pad of the prior art requiring fewer components than the prior art and the present invention is less costly to manufacture.

DETAILED DESCRIPTION OF A PREFERRED EMBODIMENT

Figure 2A:
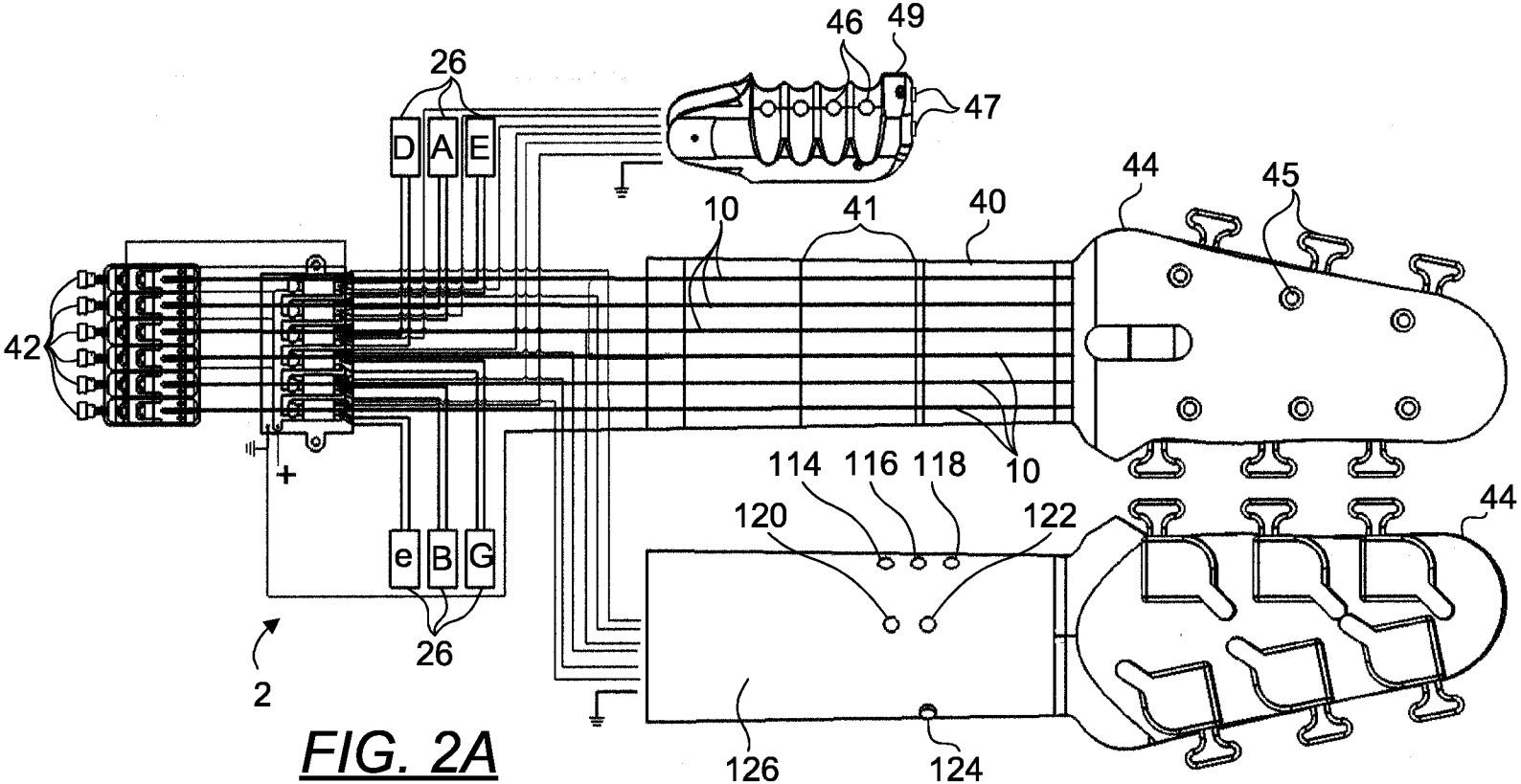
FIG. 2A is a schematic view of the present invention depicting electrical circuits configured to receive user inputs via buttons disposed on a handle, a front surface of the fretboard and a rear surface of the fretboard.

FIG. 1 is a front orthogonal view depicting plectrum assemblies 14, a handle 49 for remote picking of one or more strings (without exerting a note) and a bridge 42 according to the present invention as installed on a guitar body 8. As depicted, a six-string guitar 3 comprising six vibratory strings 10 is shown equipped with the present invention. Each vibratory string 10 is coupled with an actuating assembly for automatically picking a string 10 when the string 10 is pressed against a fret 41. The guitar 3 is further equipped with a bridge 42 for electrically isolating the strings 10 to separate electrical circuits and buttons 46, 47 for picking one or more strings 10 using fingers and thumb without using the fretboard 40. The buttons 46, 47 are disposed at a location reachable and convenient for a user's hand. In one embodiment as shown in FIGS. 1 and 2A, handle 49 is disposed at the top side 53 of the guitar 3. Buttons 46 are disposed at locations convenient for activation and configured to be depressed using fingers while buttons 47 are disposed at locations convenient for activation and configured to be operable using a thumb. As depicted in FIG. 1, buttons 46 are positioned along the length of the handle 49 while buttons 47 are positioned on the tip of the handle 49. It shall be understood that the present invention is capable of being incorporated in any string musical instrument which converts a picking action in a vibratory string to vibration and hence sound from the string. In the embodiment shown, equipment including plectrum assemblies 14 and guitar pickups 132 are disposed on plate 128 which is in turn secured to the guitar body 8 with fasteners 130. This enables easy access to the plectrum assemblies 14 and guitar pickups 132 during maintenance or repair. Although this disclosure is directed to a guitar, the present invention can be used in any string musical instruments, such as but not limited to, electric, acoustic or bass guitars, banjos, mandolin, ukulele, harp, cello, and the like.

FIG. 2A is a schematic view of the present invention depicting automatic pick 2 electrical circuits configured to receive user inputs via buttons disposed on a handle 49, a front surface of the fretboard 40 and a rear surface 126 of the fretboard 40. The schematic shows user inputs (buttons 46, 47) disposed on a handle 49, a fretboard 40 with a headstock 44 and a rear surface of the fretboard 40. Similar to a conventional guitar, a machine head 45 may still be provided for adjusting the tension in each string 10. A first set of electrical circuits includes a plurality of electrically common and conductive frets 41 spaced in the lengthwise direction of the fretboard 40. Strings 10 are electrically isolated via a bridge 42. Each string 10 is electrically connected to a solenoid 26 and a power supply 43 (see FIG. 2B).

In order to actuate a solenoid 26, a corresponding string 10 is pressed against a fret 41 such that an electrical circuit is completed. Electrically similar to the strings 10 and frets 41 combination, a second set of electrical switches actionable via buttons 46 and 47 is disposed on the handle 49 to receive inputs from a user for picking strings without contacting the fretboard 40. In one embodiment, there is further disposed another set of electrical switches actionable via buttons 114-124 on the rear surface 126 of a fretboard 40. Each of these buttons is configured to receive a command for strumming of an additional string not depressed while a note is being played, e.g., in performing E, A, D, B, G and e chords. These buttons are disposed at locations accessible to a hand used to play notes on the fretboard, thereby allowing the use of these buttons and the strings 10 simultaneously using only one hand. This enables a user who desires to pluck one or more strings without playing a note (pressing one or more strings against one or more frets).

Figure 2B:
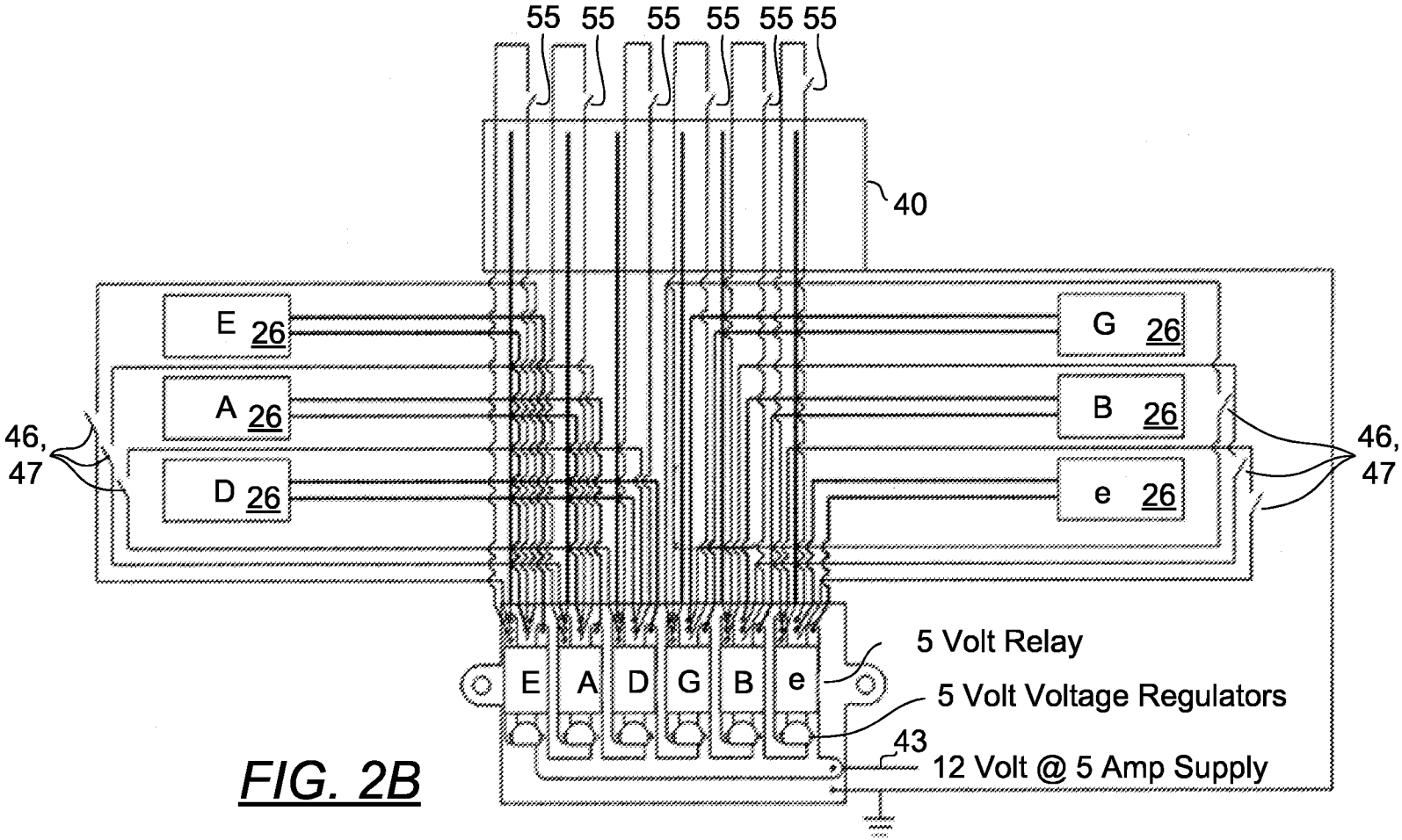
FIG. 2B is a schematic view of the present invention depicting electrical circuits configured to receive user inputs and actuators which generate picking actions.

FIG. 2B is a schematic view of the present invention depicting electrical circuits configured to receive user inputs and actuators which generate picking actions. In one embodiment, the power supply 43 is a DC power source rated at 12V and 5 A. A 5V voltage regulator is used to bring down the input voltage of 12V to signal level of 5V across each string 10 in order to further reduce potential hazards posed by the 12V input. Such power level is safe for human contact, thereby enabling a user to use his or her unprotected finger to press a string 10 against a fret 41 to actuate a solenoid 26.

However, such low power level (due to low voltage) is insufficient for powering the present solenoids 26. Therefore a 5V relay is electrically connected to each string to actuate a solenoid 26. Switches 55 represent the enablement and disablement of contacts between the strings 10 and the frets 41. As disclosed earlier, buttons 46, 47, and 114-124 (not shown in FIG. 2B) enable the generation of a string sound without having to play a note using switches 55. Each button 46, 47, 114-124 is essentially a switch which completes one of the 5V relay circuits when depressed, thereby actuating the corresponding solenoid 26. When a button 46, 47, 114-124 is released, its corresponding relay is deactivated, thereby de-energizing the solenoid 26.

Figure 3:
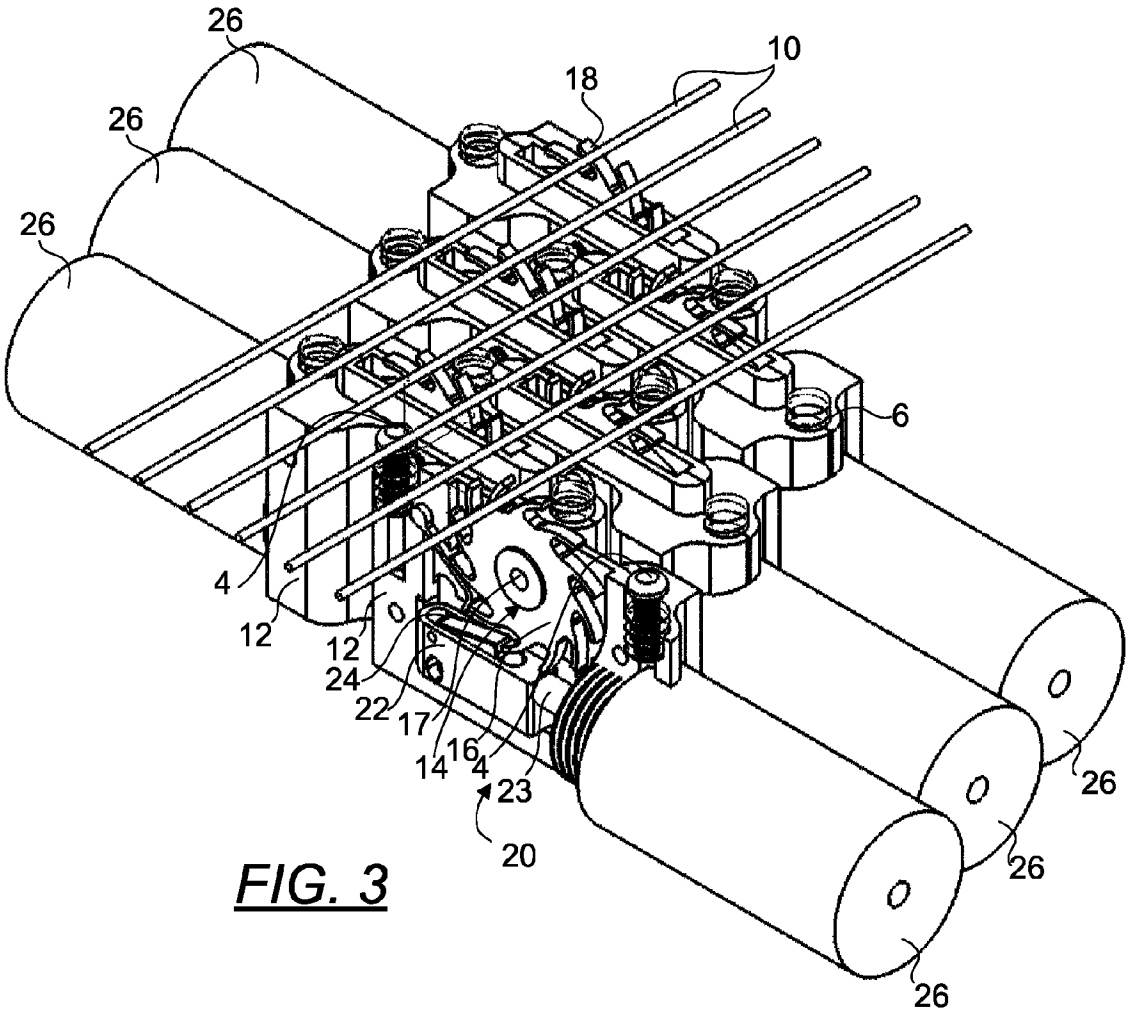
FIG. 3 is a top perspective view of a plurality of actuating and detent assemblies of the present invention depicting six plectrum wheels, each configured to pick a string.

FIG. 3 is a top perspective view of a plurality of plectrum assemblies 14 of the present invention. As depicted, there are six plectrum wheels 16, each configured to pick a string 10. One of the six plectrum assemblies 14 is shown in cutaway configuration to reveal an actuating assembly 20. Each plectrum assembly 14 comprises a plectrum housing 12. In use, a plectrum assembly 14 is fixedly secured to a guitar body 8 (refer to FIG. 1) by a pair of position screws 4 and matching threaded apertures 6. Each position screw 4 is positioned through a through hole 7 disposed in the guitar body 8 and screwed into a threaded aperture 6 disposed in the plectrum housing 12. In one embodiment, each through hole 7 is an elongated slot such that the lateral distance between a plectrum assembly 14 and a corresponding string 10 can be adjusted.

Figure 4:
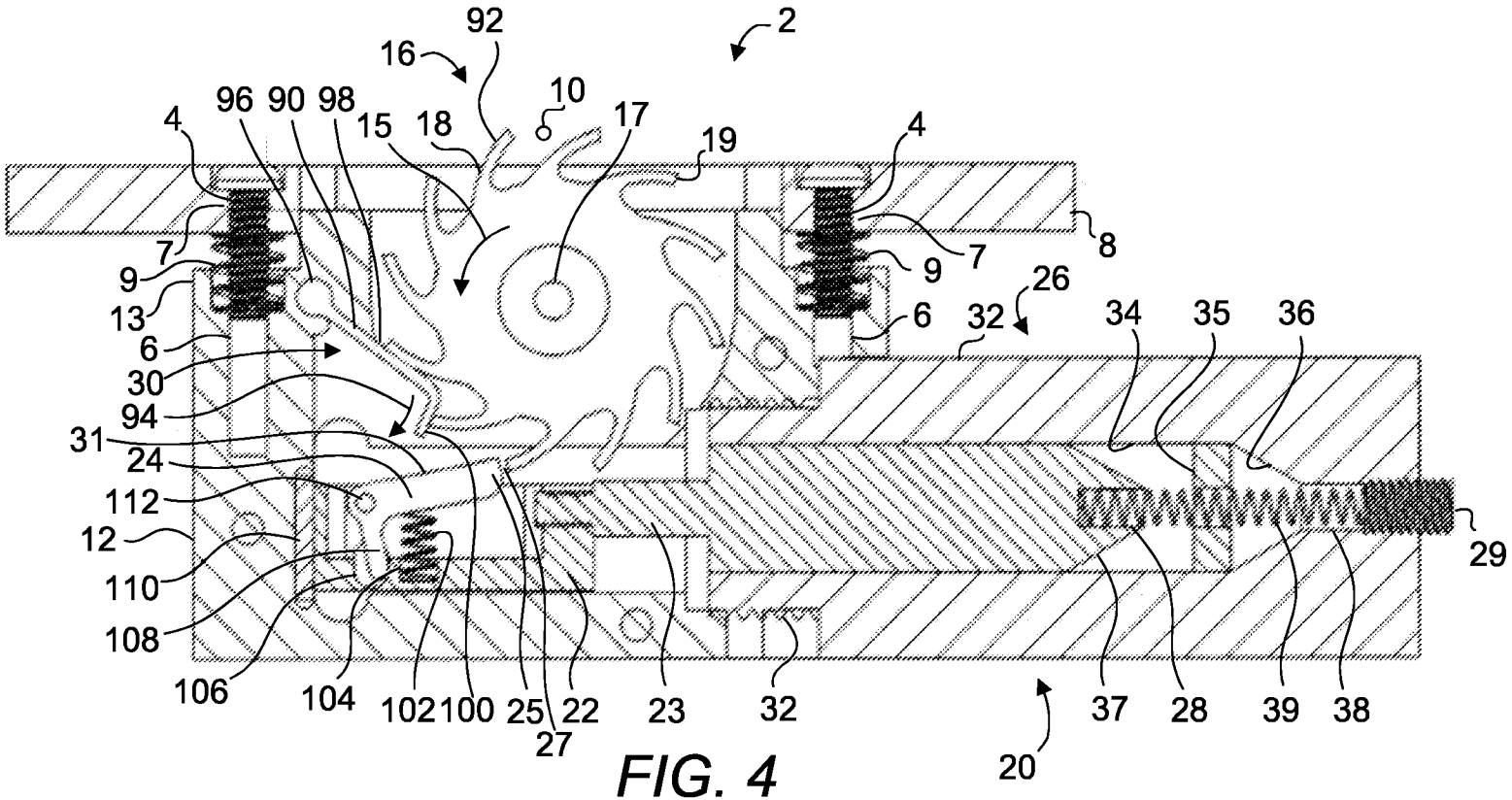
FIG. 4 is an orthogonal side cutaway view of an actuating assembly and a detent assembly depicting a solenoid used to generate picking action via a plectrum wheel and a detent mechanism for predictably positioning the plectrum wheel for subsequent solenoid actuation.

FIG. 4 is an orthogonal side cutaway view of an actuating assembly 20 and a detent assembly 30 depicting a solenoid 26 used to generate picking action via a plectrum wheel 16 and a detent mechanism for predictably positioning the plectrum wheel 16 for successive solenoid 26 actuation. Each plectrum assembly 14 comprises an actuating assembly 20 and a detent assembly 30. Each actuating assembly 20 comprises a solenoid 26 having a core 23 and a return spring 39, a plectrum wheel 16 having a plurality of teeth 18 symmetrically and angularly disposed about the periphery of the plectrum wheel 16, a shuttle 22 fixedly connected to the core 23, a striker 24 having an elongated tip and a plectrum wheel support 17. The striker 24 is pivotably connected at hinge 112 and springingly connected to the shuttle 22 with striker spring 102 which is secured at one end in a spring locator 104 and the striker 24 at the opposite end. The striker 24 includes a horn 108 which extends into a limiter 106 configured to limit the rotation of the striker 24 about hinge 112. An absorber 110 is provided to soften the impact of shuttle 22 against the plectrum housing 12 during a return stroke of the solenoid 26. The striker 24 is sprung to enable its tip 25 to clear a plectrum wheel tooth 18 as core 23 moves from its retracted to extended position. As the shuttle 22 moves from the retracted to the extended position, the outer surface 31 of the striker 24 comes in contact with the convex surface 92 of a plectrum wheel tooth where the striker 24 deflects downwardly and compresses spring 102. The detent assembly 30 aids in detenting the plectrum wheel 16 while the striker 24 comes in contact with a tooth 18. As the striker 24 clears the tooth 18, spring 102 returns striker 24 to its sprung position where the horn 108 is limited by limiter 106. The L-shaped spring 90 prevents rotation of the plectrum wheel 16 in a direction opposite that of direction 15.

Each plectrum assembly 14 is positioned such that the axis of rotation of the plectrum wheel 16 is substantially parallel to a string 10. The plectrum housing 12 is secured to a guitar body 8 using a pair of position screws 4 disposed via through holes 7 and mated to threaded apertures 6 disposed in the actuating assembly 20. At rest, a string 10 is positioned between two consecutive teeth 18 of a plectrum wheel 16. Each actuating assembly 20 comprises a solenoid 26 having a core 23 and a return spring 39, a plectrum wheel 16 having a plurality of teeth 18 symmetrically and angularly disposed about the periphery of the plectrum wheel 16, a shuttle 22 fixedly connected to the core 23, a striker 24 having an elongated tip 25 and a plectrum wheel support 17.

During solenoid 26 actuation, the core 23 is retracted such that it slides along guide 34 within coil housing 32 with plug 37 moving towards receiver 36 and compressing return spring 39. The return spring 39 is securely disposed on one end in the spring locator 28 of the solenoid core 23 and the other end in the spring locator 38 of the coil housing 32. As solenoid 26 actuation ceases, the return spring 39 returns the core 23 to its rest position. A spring adjustor 29 is essentially a set screw disposed on and urging one end of the return spring 39. As the screw is tightened, the return spring 39 is further compressed, thereby limiting the travel distance of the core 23 or limiting the impact of the plug 37 against the receiver 36 during solenoid 26 actuation. Applicant discovered that by disposing an absorber 35 between the plug 37 and the receiver 36, the impact exerted by the plug 37 against the receiver 36 is reduced, thereby silencing the solenoid 26 actuation.

Each plectrum assembly 14 is positioned such that a string 10 is substantially parallel to the plectrum wheel support 17 about which the plectrum wheel 16 rotates. Each detent assembly comprises an L-shaped spring 90 having a first and second convex surfaces 98, 100, a proximal end and a distal end. The distal end of the L-shaped spring is fixedly disposed with respect to the plectrum wheel support 17 and attached at attachment point 96. At rest, the convex surfaces 98, 100 of the L-shaped spring 90 urge against the convex surface 92 of one trailing plectrum wheel tooth 18 and the tip 19 of an adjacent leading plectrum wheel tooth 18. As the plectrum wheel 16 rotates by an angle corresponding to one tooth, the L-shaped spring 90 is bent in direction 94 and a leading tooth 18 urges against the L-shaped spring 90 before the L-shaped spring 90 becomes relieved as the leading tooth 18 clears the L-shaped spring 90 and rests between two consecutive teeth 18. In use, the actuating assembly 20 works in concert with the detent assembly 30 to result in sound creation due to vibration of the string 10, imparting sufficient and predictable picking period and predictably positioning the plectrum wheel for subsequent solenoid 26 actuation. The term picking period as used in this disclosure shall mean the period between the moment of contact of a plectrum wheel tooth 18 with a string 10 and the moment of departure of the plectrum wheel tooth 18 from the string 10.

The plectrum wheel 16 is preferably constructed from a resilient material including but not limited to nylon, teflon, spring steel, and the like.

Referring to FIGS. 2A, 2B and 4, pressing a string 10 against a fret 41 or depressing a button 46, 47, 114-124 energizes a solenoid 26 such that the solenoid core 23 is retracted. When the solenoid is de-energized, return spring 39 returns the core 23 to its extended position. The plectrum wheel 16 comprises a plurality of teeth 18 symmetrically and angularly disposed about the periphery of the plectrum wheel 16. A plectrum wheel support 17 is fixedly disposed with respect to the solenoid 26. The plectrum wheel 16 is configured to rotate about the plectrum wheel support 17. The shuttle 22 is fixedly attached to the core 23 such that when the solenoid 26 is energized, a tip 25 of the striker 24 comes in contacting engagement at 27 with the tip 19 of a first tooth 18 of the plectrum wheel 16, thereby causing the plectrum wheel 16 to rotate in direction 15 by an angle of rotation corresponding to one tooth 18 of the plectrum wheel 16. When the solenoid 26 is de-energized, the shuttle 22 extends such that the elongated tip 25 of the striker 24 contacts an adjacent tooth of the first tooth 18 of the plectrum wheel 16 and bends to clear the adjacent tooth. During this period of solenoid 26 actuation, one of the plurality of plectrum wheel teeth 18 contacts, pulls and subsequently releases a string 10 as the plectrum wheel 16 completes an angle of rotation corresponding to one tooth 18, thereby causing the string 10 to vibrate. During this same period, the L-shaped spring 90 urges against two consecutive teeth 18 such that plectrum wheel 16 rotates by an angle corresponding to one tooth. The L-shaped spring 90 is bent in direction 94 as a tooth 18 urges against it (before the L-shaped spring 90 becomes relieved) as the tooth 18 which contacted the string 10 clears the string 10 and rests between two consecutive teeth 18.

In order to minimize delay in vibrating a string 10, the tip 25 of the striker is configured to butt against the tip 19 of a tooth at rest.

In order to facilitate height adjustment of a plectrum assembly 14, the plectrum assembly 14 is adjustably attached at two points using two position screws 4. Each position screw 4 is inserted via a through hole 7 disposed in the guitar body 8, an adjustment spring 9 and mated to a threaded aperture 6 in each plectrum housing 12. As a position screw 4 is rotated, the plectrum assembly 14 is either raised (further compressing the adjustment spring 9) or lowered (decompressing the adjustment spring 9), thereby changing the height of the plectrum assembly 14 with respect to the guitar body 8.

Figure 4A:
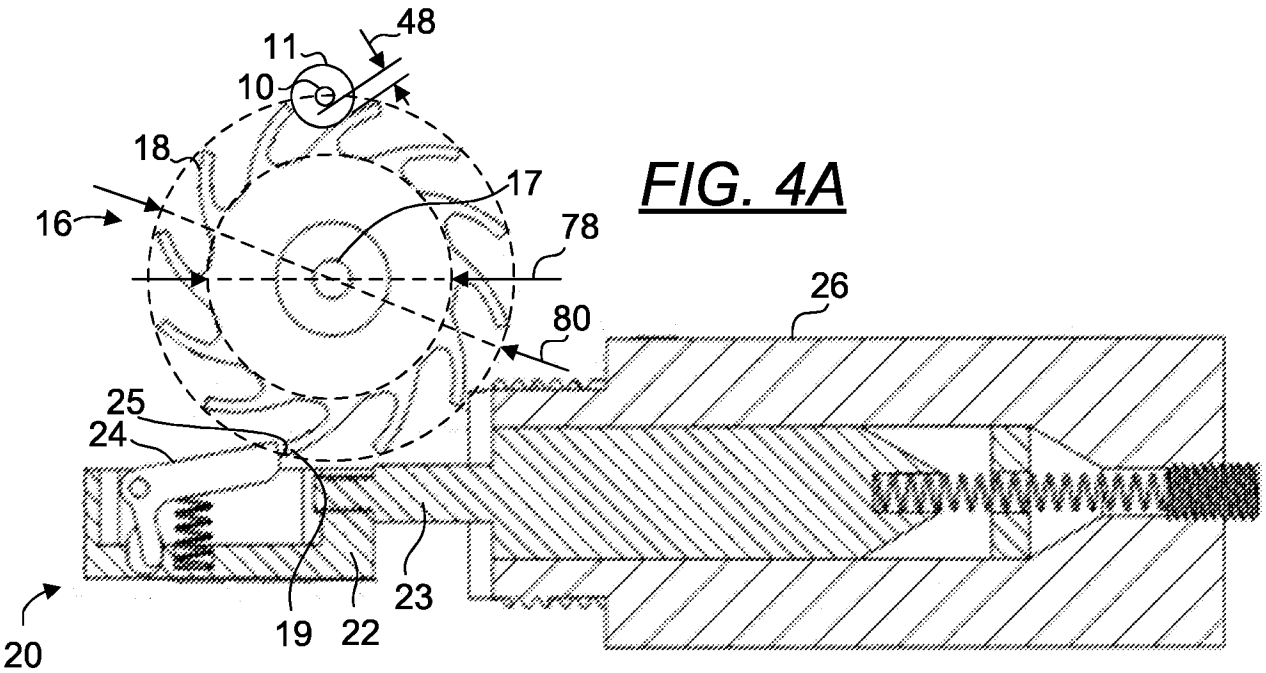
FIG. 4A is an orthogonal side view of a portion of the actuating assembly depicted in FIG. 4 illustrating the positioning of a plectrum wheel with respect to a string at rest.

FIG. 4A is an orthogonal side view of a portion of the actuating assembly 20 depicted in FIG. 4, illustrating the positioning of a plectrum wheel 16 with respect to a string 10 at rest. At rest, the string 10 is positioned at a distance 48 of from about 0.125 to about 0.15 inch from the closest plectrum wheel tooth 18. This distance 48 is critical in that it dictates the amount of time required to pick a string 10. The smaller the distance 48, the less time it takes to pick a string 10. This distance 48 is further sized such that it enables the string 10 to vibrate at a maximum amplitude without contacting a tooth 18. In one embodiment, the plectrum wheel 16 has an outer diameter 78 excluding the teeth of from about 0.625 to about 0.750 inch. The outer diameter 80 including the teeth ranges from about 0.875 to about 1.125 inch. At these diameters, the number of teeth is preferably 16. A string of a guitar typically ranges from about 0.010 to about 0.046 inch in diameter and creates a string vibration amplitude 11 of from about 0.01 to about 0.05 inch when picked. The solenoid 26 is preferably a DC solenoid rated at about 12 volts DC and 0.9 A for delivering a minimum linear force of from about 0.1 to about 0.3 lb.

Figure 4B:
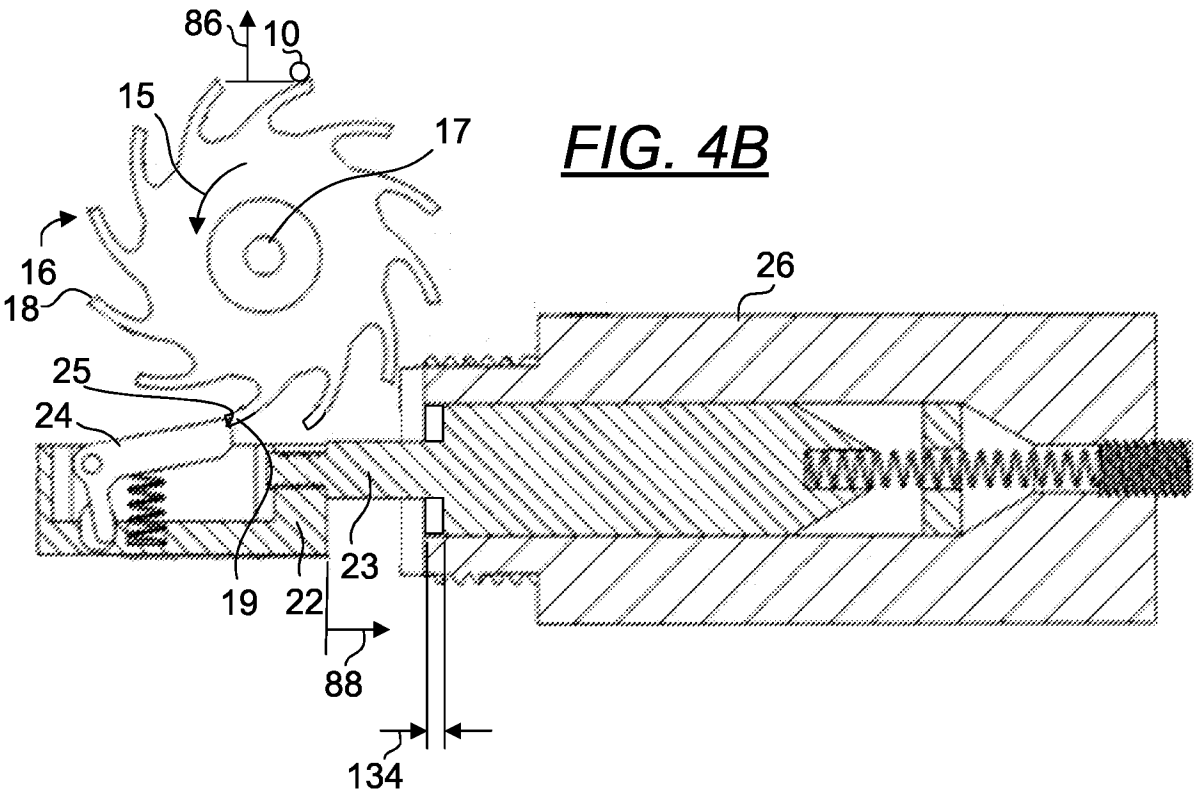
FIG. 4B is an orthogonal side view of a portion of the actuating assembly depicted in FIG. 4 illustrating a state of the actuating assembly upon activating the actuating assembly.

FIG. 4B is an orthogonal side view of a portion of the actuating assembly 20 depicted in FIG. 4 illustrating a state of the actuating assembly 20 upon its activation. When the solenoid 26 is energized, the core 23 retracts to cause an angle of rotation in the plectrum wheel 16 corresponding to a plectrum wheel tooth 18. In one embodiment, a plectrum wheel tooth 18 first contacts the string 10 after the plectrum wheel 16 has rotated about 19 degrees in direction 15 from its resting position. Upon contacting the string 10, the plectrum wheel tooth 18 continues to pull the string 10 by lifting the string 10 such that the string 10 rises in direction 86 of from about 0.012 to 0.027 inch outwardly from the center of the plectrum wheel 16 before releasing the string 10 after having rotated about 11 degrees from its resting position. Upon the release of the string 10, a sound is generated by the vibration of the string 10. The required retraction of solenoid 26 in direction 88 to generate such picking action of the string 10 is about 0.167 inch. In one embodiment, the solenoid is capable of a maximum stroke 134 of 0.334 inch.

Figure 5:
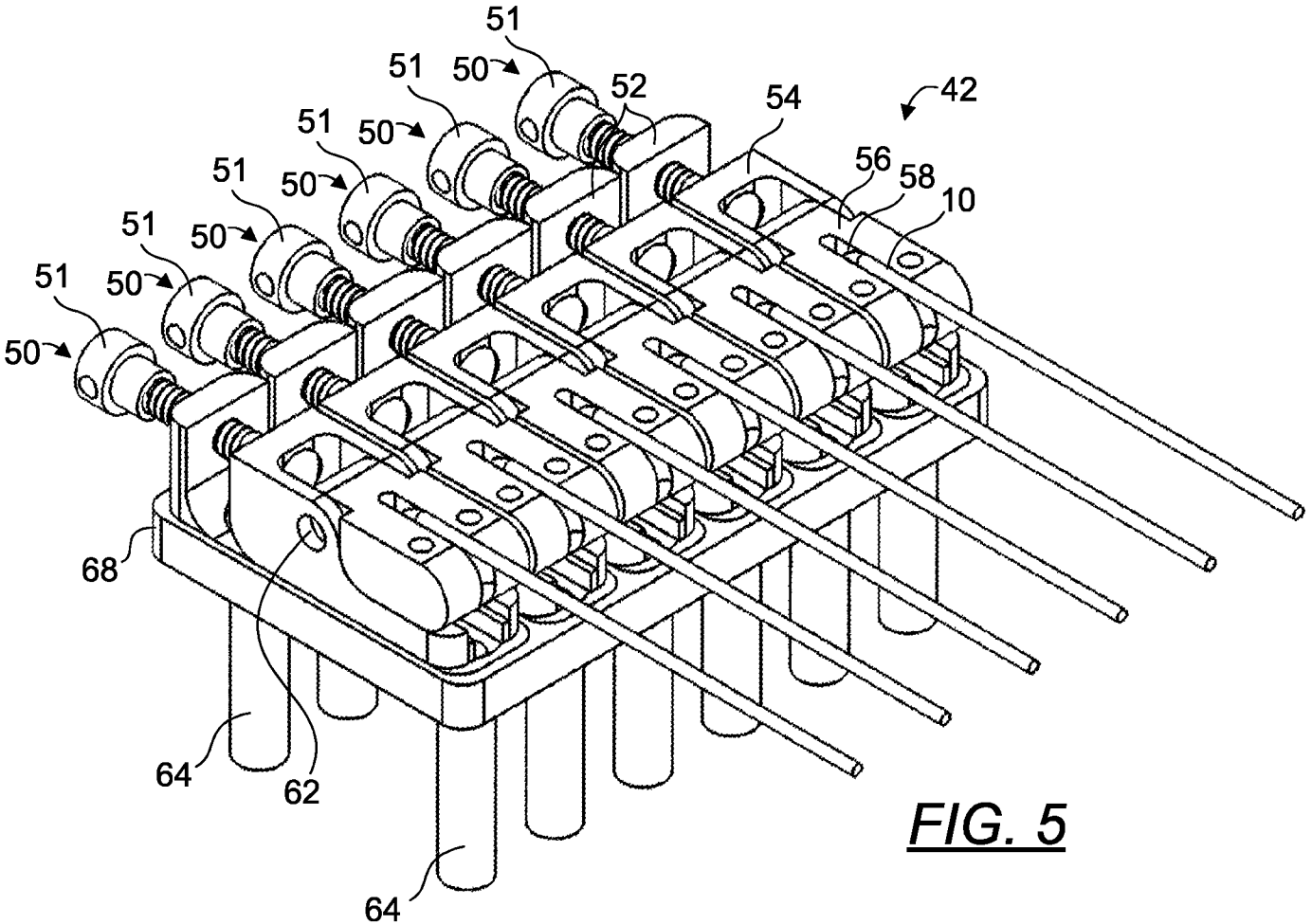
FIG. 5 is a top front perspective view of a bridge according to the present invention.
Figure 6:
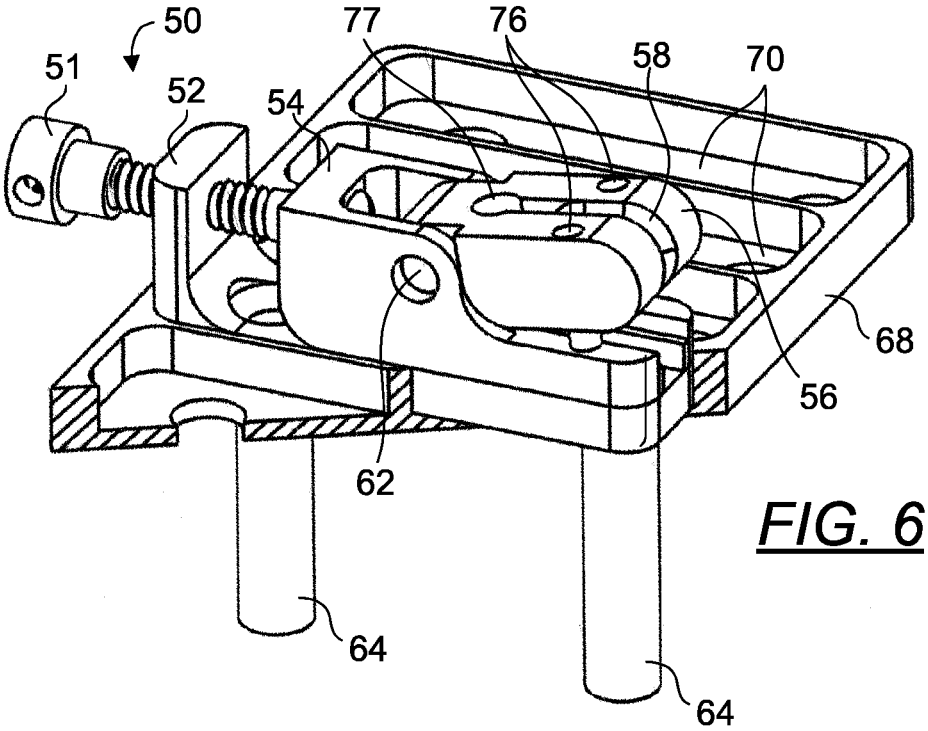
FIG. 6 is a partial top front perspective view of a bridge according to the present invention depicting a fine tuner as it is installed in an isolator block.
Figure 7:
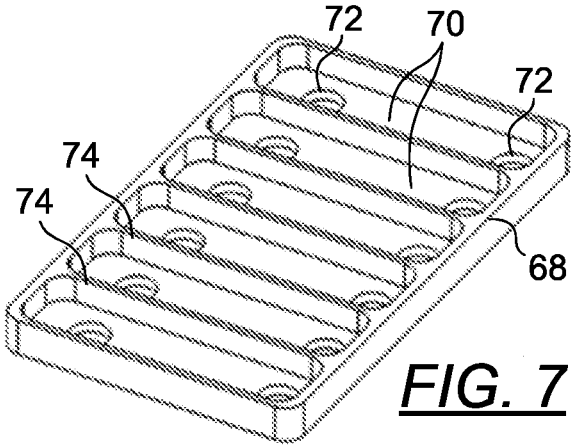
FIG. 7 is a top front perspective view of an isolator block depicting the slots in which a plurality of fine tuners can be installed to achieve electrical isolation.

FIG. 5 is a top front perspective view of a bridge 42 according to the present invention. FIG. 6 is a partial top front perspective view of a bridge 42 depicting a fine tuner 50 as it is installed in an isolator block 68 to provide electrical isolation to each string circuit. FIG. 7 is a top front perspective view of an isolator block 68 depicting the slots 70 in which a plurality of fine tuners 50 can be installed to achieve electrical isolation. Referring to FIGS. 5, 6 and 7, the bridge 42 comprises an isolator block including at least two adjacent slots 70 and a plurality of fine tuners 50, one for each string 10. As depicted in FIG. 7, the isolator block 68 further comprises at least one aperture 72 in each slot 70 for routing through a string 10 such that each string 10 can be wired to be electrically conductive within a guitar body 8 on which the bridge 42 is mounted. In a preferred embodiment, there are two apertures 72, through one of which a string 10 may be routed through. Additionally or alternatively, the isolator block 68 may include posts 64. Such posts 64 may be hollow, concentrically disposed with each aperture 72 and fixedly attached to the isolator block 68 to aid in positioning the isolator block 68 and to provide structural integrity to the installation of the isolator block 68 to a guitar body 8. Each slot 70 comprises a shared wall 74 which electrically isolates the slot 70 from one or more of its adjacent slots. The isolator block 68 is preferably constructed from nylon although other non-electrically conductive materials may function equally well.

Each fine tuner 50 comprises a cradle 52, a slider block 54 configured to slide along the cradle 52 and an adjustment screw 51 for adjusting the positioning of the slider block 54 with respect to the cradle 52. Each fine tuner 50 further comprises a swing arm 56 pivotably connected to the slider block 54 at pivot 62, a pair of set screws 76 for enabling adjustment of the swing arm 56 angle with respect to the slider block 54, and a channel 58 for receiving a string 10 which is routed through an opening 77 in the slider block 54.

Figure 8:
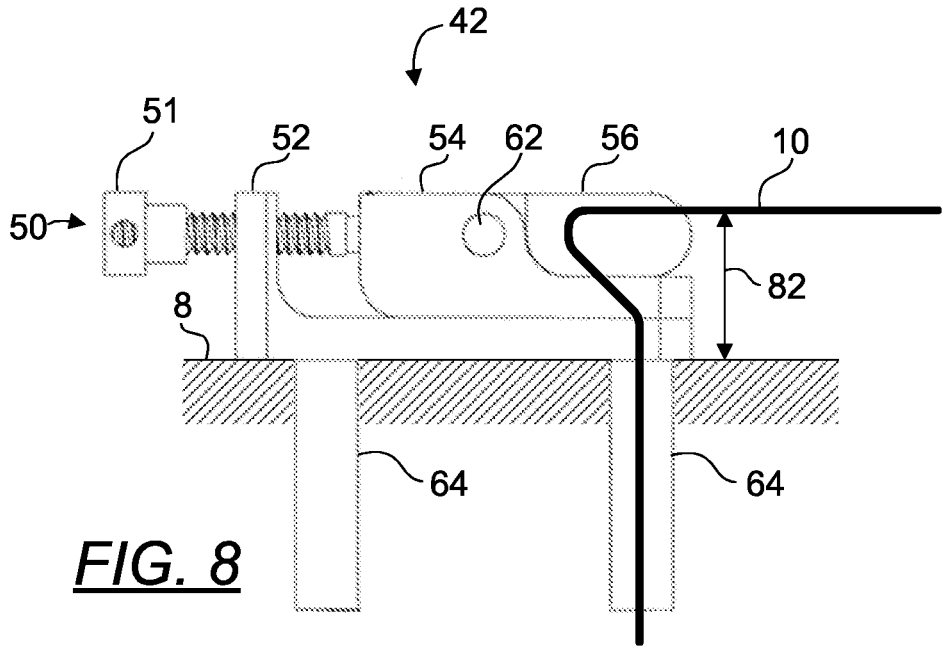
FIG. 8 is an orthogonal side view of a bridge according to the present invention depicting a swing arm in its stowed position.
Figure 9:
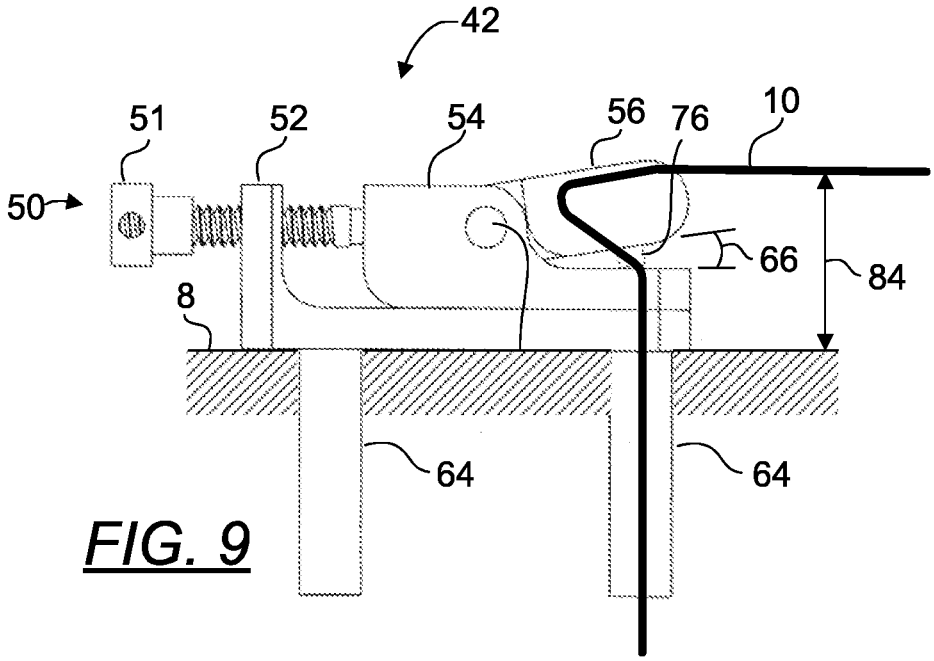
FIG. 9 is an orthogonal side view of a bridge according to the present invention depicting a swing arm in its erected position.

FIGS. 8 and 9 are orthogonal side views of a bridge 42 depicting a swing arm 56 in its stowed and erected positions, respectively. Each fine tuner 50 is used for adjusting the height of a string 10 with respect to a guitar body 8 on which the string 10 is mounted. At its retracted position (as depicted in FIG. 8), the swing arm 56 lays flat on the slider block 54 to result in a string height 82 of substantially at the bridge 42 from the guitar body 8. At its erected position (as depicted in FIG. 9), the swing arm 56 is pivoted about a pivot 62 to result in an angle 66 between the swing arm 56 and the slider block 54 and a string height 84 of substantially at the bridge 42 from the guitar body 8. In this embodiment, two set screws 76 are used to adjust the angle 66 between the swing arm 56 and the slider block 54 with each set screw 76 disposed on one side of the channel 58. It shall be noted that in addition to providing electrical isolation to strings 10, the present bridge 42 is used to adjust the height of the strings 10 with respect to a plectrum wheel 16.

It will be appreciated by those skilled in the art that while the invention has been described above in connection with particular embodiments, the invention is not necessarily so limited and that numerous other embodiments, uses, modifications and departures from the embodiments, and uses may be made without departing from the inventive concepts.

I claim:

1. An automatic string musical instrument pick system comprising:

(a) an instrument body having a fretboard comprising a plurality of electrically common and electrically conductive frets spaced along said fretboard;

(b) one or more electrically isolated and electrically conductive vibratory strings disposed on said instrument body in a laterally spaced relationship and held in tension over and in close proximity to said plurality of said frets;

(c) a picking means for each of said strings, said picking means comprising an actuating assembly powered by a power supply with a current restricted to a level safe for human contact, wherein said actuating assembly and said power supply are electrically connected to said one or more electrically isolated and electrically conductive vibratory strings;

(d) a solenoid having a core and a return spring, wherein when said solenoid is energized, said core is disposed in a retracted position and when said solenoid is de-energized, said return spring returns said core to an extended position;

(e) a plectrum wheel having a plurality of teeth symmetrically and angularly disposed about a periphery of said plectrum wheel, wherein each tooth comprises a tip;

(f) a shuttle fixedly attached to said core;

(g) a striker having a elongated tip; and (h) a plectrum wheel support, wherein said plectrum wheel support is fixedly disposed with respect to said solenoid, said plectrum wheel is configured to rotate about said plectrum wheel support and wherein when said solenoid is energized, said elongated tip of said striker comes in contacting engagement with a tooth of said plectrum wheel, thereby causing said plectrum wheel to rotate by an angle of rotation corresponding to one tooth and when said solenoid is de-energized, said shuttle extends such that said elongated tip of said striker contacts an adjacent tooth of said tooth of said plectrum wheel and deflects to clear said adjacent tooth and one of said plurality of plectrum wheel teeth contacts, pulls and releases a vibratory string as said plectrum wheel completes an angle of rotation corresponding to one tooth, thereby causing said vibratory string to vibrate.

2. The automatic string musical instrument pick system of claim 1, further comprising a detent assembly.

3. The automatic string musical instrument pick system of claim 2, wherein said detent assembly comprises an L-shaped spring having a first and second convex surfaces, a proximal end and a distal end, wherein said distal end of said L-shaped spring is fixedly disposed with respect to said plectrum wheel support and said convex surfaces of said L-shaped spring urge against a surface of one plectrum wheel tooth and the tip of an adjacent plectrum wheel tooth, such that as said plectrum wheel rotates by an angle corresponding to one tooth, said L-shaped spring is bent and a leading tooth urges against said L-shaped spring before said L-shaped spring becomes relieved as the leading tooth clears said L-shaped spring and rests between two consecutive teeth.

4. An automatic string musical instrument pick system comprising:

(a) an instrument body having a fretboard comprising a plurality of electrically common and electrically conductive frets spaced along said fretboard;

(b) one or more electrically isolated and electrically conductive vibratory strings disposed on said instrument body in a laterally spaced relationship and held in tension over and in close proximity to said plurality of said frets;

(c) a picking means for each of said strings, said picking means comprising an actuating assembly powered by a power supply with a current restricted to a level safe for human contact, wherein said actuating assembly and said power supply are electrically connected to said one or more electrically isolated and electrically conductive vibratory strings; and (d) a bridge having:

an isolator block including at least two adjacent slots, a first fine tuner, and a second fine tuner; wherein said first fine tuner is disposed in one of said at least two adjacent slots and said second fine tuner is disposed in the other of said at least two adjacent slots such that said first fine tuner is electrically isolated from said second fine tuner.

5. An automatic string musical instrument pick system having an actuating assembly, wherein said actuating assembly comprises:

(a) a solenoid having a core and a return spring, wherein when said solenoid is energized, said core is disposed in a retracted position and when said solenoid is de-energized, said return spring returns said core to an extended position;

(b) a plectrum wheel having a plurality of teeth symmetrically and angularly disposed about a periphery of said plectrum wheel, wherein each tooth comprises a tip;

(c) a shuttle fixedly attached to said core;

(d) a striker having a elongated tip; and (e) a plectrum wheel support, wherein said plectrum wheel support is fixedly disposed with respect to said solenoid, said plectrum wheel is configured to rotate about said plectrum wheel support and wherein when said solenoid is energized, said elongated tip of said striker comes in contacting engagement with a tooth of said plectrum wheel, thereby causing said plectrum wheel to rotate by an angle of rotation corresponding to one tooth and when said solenoid is de-energized, said shuttle extends such that said elongated tip of said striker contacts an adjacent tooth of said tooth of said plectrum wheel and deflects to clear said adjacent tooth and one of said plurality of plectrum wheel teeth contacts, pulls and releases a vibratory string as said plectrum wheel completes an angle of rotation corresponding to one tooth, thereby causing said vibratory string to vibrate.

6. The automatic string musical instrument pick system of claim 5, further comprising a detent assembly.

7. The automatic string musical instrument pick system of claim 6, wherein said detent assembly comprises an L-shaped spring having a first and second convex surfaces, a proximal end and a distal end, wherein said distal end of said L-shaped spring is fixedly disposed with respect to said plectrum wheel support and said convex surfaces of said L-shaped spring urge against a surface of one plectrum wheel tooth and the tip of an adjacent plectrum wheel tooth, such that as said plectrum wheel rotates by an angle corresponding to one tooth, said L-shaped spring is bent and a leading tooth urges against said L-shaped spring before said L-shaped spring becomes relieved as the leading tooth clears said L-shaped spring and rests between two consecutive teeth.

8. The automatic string musical instrument pick system of claim 5, wherein said actuating assembly further comprises a switch electrically connected to said actuating assembly, and wherein said switch is capable of independently actuating said actuating assembly.

9. The automatic string musical instrument pick system of claim 5, wherein said plectrum wheel is formed of a material selected from a group consisting of nylon, Teflon and spring steel.

* * * * *